United States Patent [19]

Ishikawa et al.

[11] 4,197,436

[45] Apr. 8, 1980

[54] TIMER MECHANISM

[75] Inventors: Tadashi Ishikawa, Yoshikawamachi; Kiyoyuki Arai, Tokyo, both of Japan

[73] Assignee: Copal Company Limited, Tokyo, Japan

[21] Appl. No.: 852,794

[22] Filed: Nov. 18, 1977

[30] Foreign Application Priority Data

Nov. 19, 1976 [JP] Japan ..... 51-139119

[51] Int. Cl.[2] ..... H01H 43/00

[52] U.S. Cl. ..... 200/37 R; 200/38 R

[58] Field of Search ..... 200/35 R, 36, 37 R, 200/37 A, 38 A, 38 F

[56] References Cited

U.S. PATENT DOCUMENTS

| | | | |
|---|---|---|---|
| 3,825,702 | 7/1974 | Morata et al. | 200/35 R |
| 4,000,384 | 12/1976 | Kumazawa | 200/37 R |
| 4,045,627 | 8/1977 | Kitai et al. | 200/37 R |

*Primary Examiner*—James R. Scott
*Attorney, Agent, or Firm*—J. Harold Nissen

[57] ABSTRACT

A timer mechanism for a clock which has a manually settable rotatable timer drum. A pair of complementarily arranged semicircular contacts which are electrically insulated from each other are adapted to actuate the timer when electrically connected to each other. Two contact fingers are provided which are urged into contact with the respective semicircular stationary contacts. A timer cam between the timer drum and a projecting lug associated with one of the contact fingers for prevention thereof from contacting one of the semicircular contacts and thereby render the timer inoperative. A flange with a cutout is provided on the timer cam which permits the one of the contact fingers to contact the semicircular stationary contact and thereby actuate the timer.

6 Claims, 8 Drawing Figures

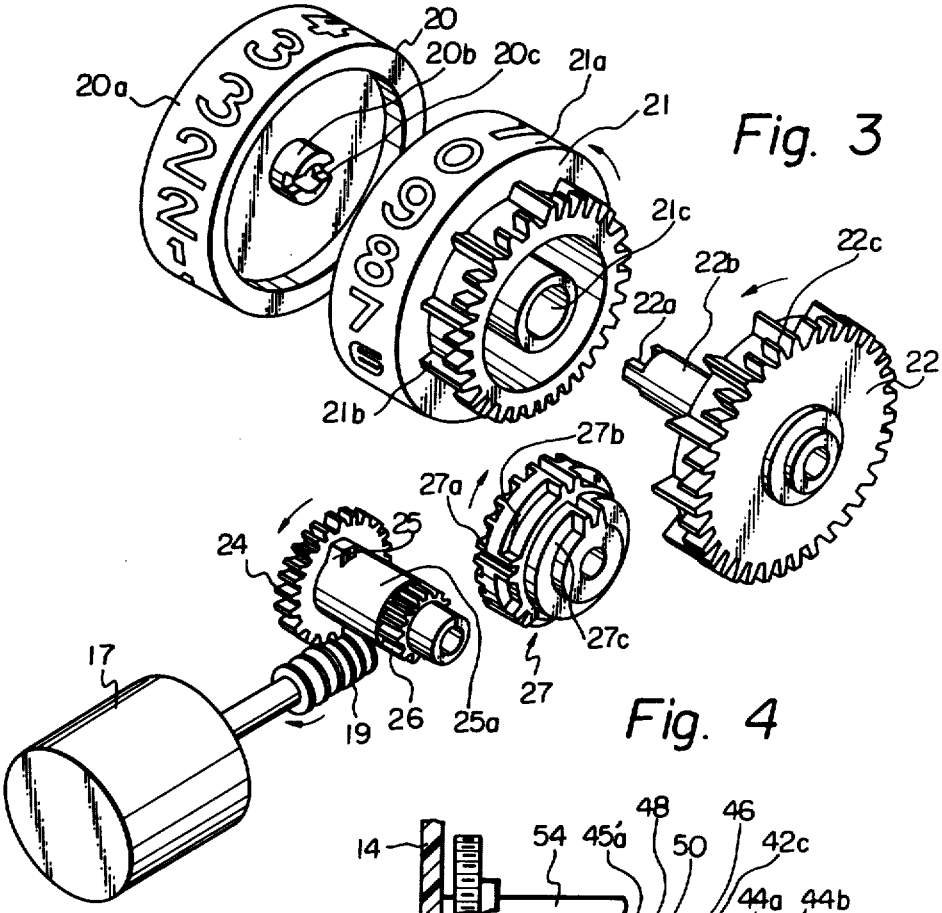
Fig. 3
Fig. 4
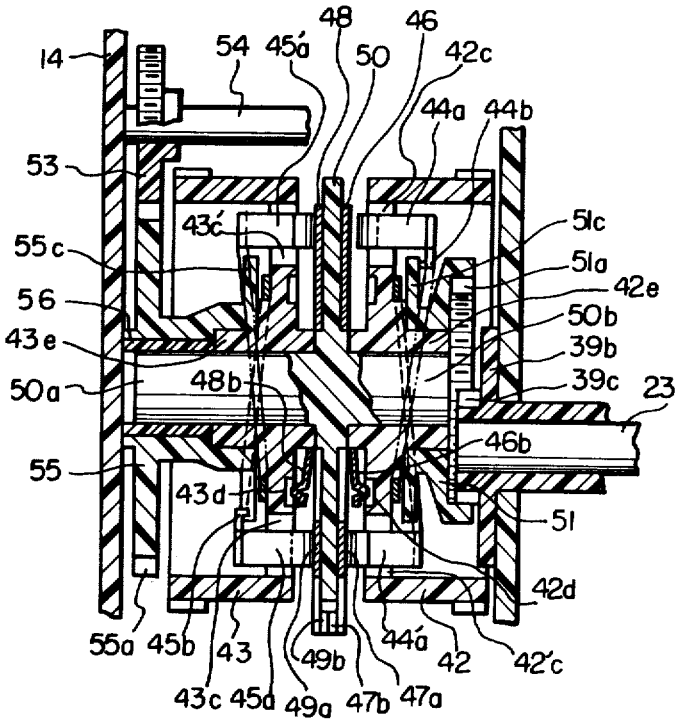

TIMER MECHANISM

BACKGROUND OF THE INVENTION

The present invention relates to a timer mechanism in a clock.

Heretofore, a timer mechanism in a clock has been proposed having at least a manually settable timer drum for manually setting the time at which the timer is to be actuated and having a pair of diametrically oppositely located throughholes, a pair of complementarily arranged semicircular stationary contacts electrically insulated from each other and adapted to actuate the time when they are electrically connected to each other, a resilient contact member rotated in coupled relation to the clock mechanism and having a pair of diametrically oppositely located contact fingers adapted to be moved through the respective throughholes of the timer drum when they are brought in registered relationship with each other during the rotation of the resilient contact member so that the contact fingers contact with the respective semicircular stationary contacts thereby actuating the timer at the set time as set in the timer drum.

In such a timer mechanism, however, the timer drum is normally molded from a plastic material requiring the wall thickness thereof to be substantially great in order to maintain the mechanical strength permitting the throughholes to be formed therein and the timer drum to be accurately manipulated by the operator's hand. Therefore, the movement of the contact fingers of the resilient contact member through the throughholes for effecting the electrical connection to the semicircular stationary contacts must be made great so that substantially great spring force of the contact fingers is required to insure proper actuation of the fingers. Thus, the torque for rotating the resilient contact member having its fingers frictionarily sliding along the wall of the timer drum during the rotation of the resilient contact member must be substantially great thereby resulting in the large consumption of electric power while the variation in load during the actuation of the timer is made great.

The present invention aims at avoiding the above described disadvantages of the heretofore proposed timer mechanism.

SUMMARY OF THE INVENTION

The object of the present invention is to provide a novel and useful timer mechanism in a clock which positively avoids the above described disadvantages and insures very light and smooth actuation of the timer mechanism while reducing the consumption of electric power and variation in load affecting the clock mechanism.

The above object is achieved in accordance with the characteristic feature of the present invention by securing the resilient contact member to the timer drum in a timer mechanism of the type as described above so as to permit the pair of contact fingers to be urged through the throughholes at all times, wherein one of the contact fingers is provided with a projecting lug adjacent thereto which abuts against a flange of a timer cam member rotated in coupled relationship with the clock mechanism so that the contact finger provided with the projecting lug is normally prevented from contacting the semicircular stationary contact, the flange being provided with a cutout portion allowing the projecting lug to be released from the flange when the cutout portion is brought in registration with the projecting lug during the rotation of the timer cam member so that the contact finger having the projecting lug is permitted to contact with the semicircular stationary contact thereby actuating the timer mechanism at the set time.

This construction permits the light and smooth actuation of the timer mechanism and the reduction of the consumption of the electric power as well as the variation in load during the actuation of the timer mechanism thereby insuring the accurate actuation of both the clock and timer mechanisms.

According to the invention there is provided a timer mechanism for a clock which has a manually settable rotatable timer drum formed with a pair of diametrically oppositely located throughholes. A resilient contact member is secured to the timer drum and has a first contact finger urged through one of the throughholes and a second contact finger urged through the other throughhole. A pair of complementarily arranged semi-circular contacts which are electrically insulated from each other are adapted to actuate the timer when electrically connected to each other. The two contact fingers are urged into contact with the respective semicircular stationary contacts, and a timer cam member having a flange is interposed between the timer and is rotated in coupled relation to the actuation of the clock so that the second contact finger is normally prevented from making contact with the semicircular stationary contact so as to render the timer operative. The flange is provided with a cutout portion which permits the projecting lug to be released from the flange and permits the second contact finger to make contact with the semicircular stationary contact and thereby to actuate the timer when the contact portion is brought to the position of the lug. The angular position of the cutout portion is so determined with respect to the time graduations on the timer drum that the timer is actuated as the set time as set in the timer drum with the aid of the time graduations thereon. The timer mechanism permits a very light and smooth operation of the switching of the contacts and a saving of electric power, because it is not necessary to rotate the two contact fingers of the resilient contact members and thereby cause a substantial frictional resistance as in the case of the well known timer mechanism, but it is only necessary to arrest or release the projecting lug by or from the flange of the rotating timer cam member by the provision of the cutout portion in order to cause the connection of the stationary contacts with the respective contact fingers for actuating the timer.

BRIEF DESCRIPTION OF THE DRAWINGS

FIG. 3 is an exploded perspective view showing the driving mechanism for the minute indication in the embodiment shown in FIG. 1;

FIG. 4 is a sectional view taken along line 4—4 in FIG. 1 showing the timer mechanism of the present invention;

FIG. 7(*a*) is a fragmentary sectional view showing the actuation of the switching of the name of the cities with the switch contacts held open, and FIG. 7(*b*) is a fragmentary sectional view similar to FIG. 7(*a*), but showing the switch contacts hold connected.

DETAILED DESCRIPTION OF THE PREFERRED EMBODIMENT

Figure 2:
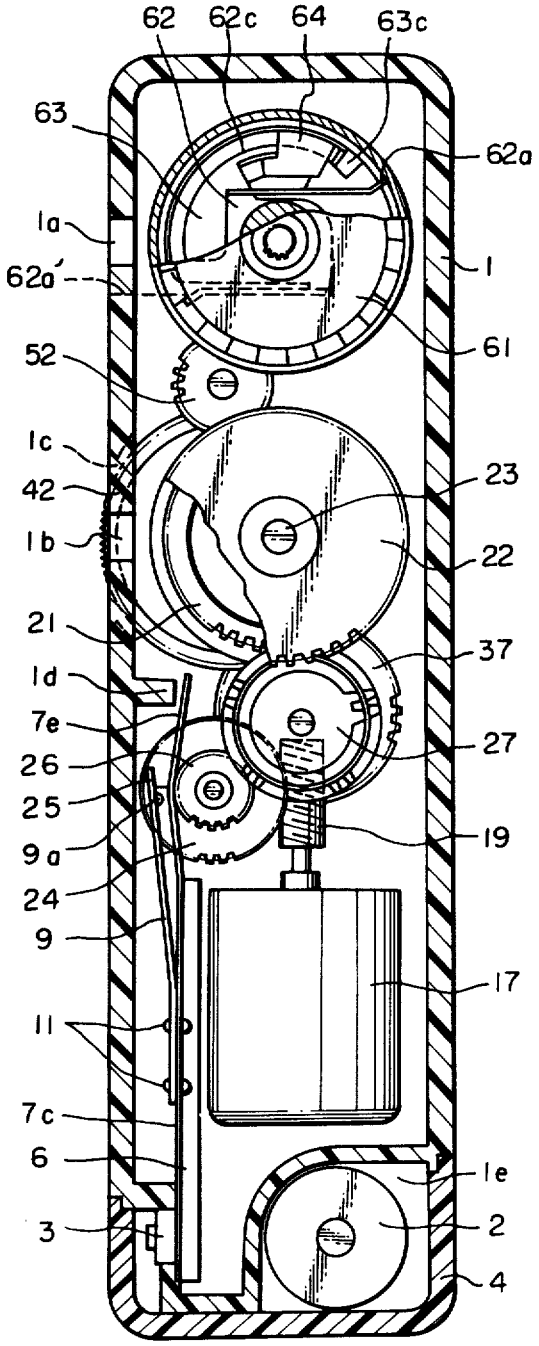
FIG. 2 is a side view with the side wall portion broken away showing the internal construction of the embodiment shown in FIG. 1.

Referring to the drawings and in particular to FIG. 2, the casing 1 for housing the time indicating device, the city indicating device and timer device is formed with an opening 1*a* for selectively indicating therethrough the name of cities in the world, an opening 1*b* for switchingly indicating therethrough the time at the city the name of which is indicated in the opening 1*a*, an opening 1*c* for exposing therethrough a portion of the timer drums to be described later for manually manipulating the same in order to set the time at which the timer is to be actuated, an inwardly projecting portion 1*d* to be described later and a housing portion 1*e* for housing an electric battery means 2.

A plurality of manually operable members 3 for manually adjusting the hour, minute and second indications of the clock are arranged in the casing 1 as shown in FIG. 2. The casing 1 is provided with a cover 4 for covering the battery 2 and the manually operable members 3.

A circuit block 5 for driving the time indicating device and other devices is housed in the casing and it comprises a quartz oscillator and the like for issuing time reference pulses which are frequency divided so as to accurately generate a pulse per minute for driving the time indicating device as described later.

A supporting plate 6 and a flexible printed circuit base plate 7 mounted on the supporting plate 6 are arranged in the casing 1. The flexible printed circuit base plate 7 is formed with an upper extended portion 7*a* for electrically connecting to the upper city indicating device and the timer device, a connecting portion 7*b* for connecting the upper extended portion 7*a* and the base plate main body 7*c*, and electrically conductive portions formed thereon for constituting stationary contacts of switch means with which conductive portions torque like contact portions 7*d*, 7*e* are integrally formed projecting upwardly therefrom, respectively. The upper end portion of each of the contact portions 7*d*, 7*e* is urged against the inwardly projecting portion 1*d* of the casing 1, respectively, by virtue of the elastic property thereof. Movable contact portions 8, 9 are secured at their one ends to the supporting plate 6 and cooperate with the contact portions 7*d*, 7*e* of the printed circuit base plate 7, respectively, so as to constitute the switch means, respectively. The other end each of the movable contact portions 8, 9 is formed with a contact 8*a*, 9*a* and a laterally projecting cam portion 8*b*, 9*b* ofthe electrically conductive, resilient material. The contacts 8*a*, 9*a* are resiliently urged against the contact portions 7*d*, 7*e*, respectively, so as to be electrically connected thereto, but, when land portions 32, 25 of worm wheels 31, 24 engage with the cam portions 8*b*, 9*b*, respectively, the contacts 8*a*, 9*a* are electrically disconnected from the contact portions 7*d*, 7*e*, respectively as described later.

Supporting base plates 12, 13, 14 are arranged in order to support the respective mechanisms of the clock, while bearing means 15 is provided in order to support the connecting shaft 36 to be described later.

An hour indicating driving motor 16 and a minute indicating driving motor 17 are provided, and worm gears 18, 19 are secured to the output shafts thereof, respectively.

As shown in FIG. 3, the minute indicating mechanism in the time indicating device comprises a tens of figure of minute indicating drum 20 having a cylindrical indicating surface 20*a* bearing thereon circumferentially two series of numerals "0", "1", ——"5" as well as a boss 20*b* in which cut-out portions 20 *c* are formed, and a ones of figure of minute indicating drum 21 having a cylindrical indicating surface 21*a* bearing thereon circumferentially a series of numerals "0", "1", ——"9" and an intermittent gear 21*b* secured at the side surface of the indicating surface 21*a* and formed with series of wider gear teeth arranged circumferentially in every three narrower gear teeth aligned therewith as shown in FIG. 3 as well as a boss 21*c*. A tens of figure of minute indicating drum driving intermittent gear 22 having intermittent gear portion 22*c* formed with wider gear teeth arranged circumferentially in every three narrower gear teeth aligned therewith is integrally formed with a boss 22*b* which rotatably extends through the boss 21*c* of the gear 21 and is drivingly connected to the boss 20*b* of the gear 20 by virtue of the engagement of the projecting lugs 22*a* formed at the end of the boss 22*b* with the cut-out portions 20*c* of the boss 20*b*. The gear 22 is fixedly secured to a main shaft 23 (see FIGS. 1 and 2). A worm wheel 24 engages with the worm gear 19 of the minute indicating driving motor 17 and has a boss 25*a* integrally formed therewith. The boss 25*a* is formed with a pair of diametrically oppositely located land portions 25 engaging with the cam portion 9*b* of the previously described contact portion 9 as well as a pinion 26 integrally formed with the boss 25*a*. A minute indicating intermittent gear 27 is formed with a gear portion 27*a* meshing with the pinion 26, a first intermittent gear portion 27*b* consisting of arcuate circumferential cam portions and intermittently arranged gear teeth portions cooperating with the intermittent gear 21*b* of the ones of figure of minute indicating drum 21 for intermittently rotating the same by an angle so as to switch once the indication of the drum 21 each time one of the intermittently arranged gear teeth portions engages with wider teeth of the gear 21*b*, and second intermittent gear portion 27*c* consisting of an arcuate circumferential cam portion and a gear teeth portion cooperating with the intermittent gear 22*c* of the tens of figure of minute indicating drum driving intermittent gear 22 for intermittently rotating the tens of figure of minute indicating drum 20 by an angle so as to switch once the indication thereof each time the ones of figure of minute indicating drum 21 rotates by half a revolution.

The hour indicating mechanism of the time indicating device is substantially similar to the above described minute indicating mechanism, and, therefore , it is not necessary to describe it in detail here. Briefly speaking, the tens of figure of hour indicating drum 28 of the hour indicating mechanism (FIG. 1) has a cylindrical indicating surface bearing thereon circumferentially two series of indications "1", "1", "2", "blank", "blank" and "blank", while the ones of figure of hour indicating drum 29 has a cylindrical indicating surface bearing thereon circumferentially a series of numerals "0", "1", ——"9" as well as an intermittent gear similar to the intermittent gear 21*b* of the ones of figure of minute indicating drum 21 integrally formed with the drum 29. The tens of figure of hour indicating drum driving intermittent gear 30 is similar in construction to the tens of figure of minute indicating drum driving intermittent gear 22 and is formed with a boss engaging with the tens of figure of hour indicating drum 28 and an intermittent gear portion similar to the gear portion 22*c* of the gear 22, the gear 30 being rotatably supported on the main shaft 23. The intermittent gear of the ones of figure of hour indicating drum 29 and the intermittent gear portion of the tens of figure of hour indicating drum driving intermittent gear 30 are driven by the hour indicating driving motor 16 through the worm wheel 31, the worm gear 18 having the pinion 33, and the hour indicating intermittent gear 34 (similar to the gear 27) driven by the pinion 33 in the similar manner as in the case of the minute indicating mechanism previously described, the land portions 32 of the worm wheel 31 cooperating with the same portion 8*b* of the movable contact portion 8 so as to electrically disconnect the contact portion 7*d* of the flexible printed circuit base plate 7 from the contact 8*a* of the movable contact portion 8 when each of the land portions 32 engages with the cam portion 8*b*.

In order to drive the hour indicating mechanism so as to indicate the hour in every 24 hour cycle, a small transmitting gear 35 is coupled with the worm wheel 31 through the connecting shaft 36, and the gear 35 meshes with a reduction gear 37 having a small gear portion which in turn meshes with the gear portion 38*a* of a 24 hour switching gear wheel 38 (FIG. 5) comprising an acruate circumferential cam portion 38*b*, a mutilated gear portion 38*c* forming an intermittent portion with omitted gear teeth corresponding to the range extending from the hour indication "23" to the portion before the hour indication "0" cut away, and a recessed cam portion 38*d* formed in the inner peripheral surface of a circular recess provided at the side of the 24 hour switching gear wheel 38. The reduction ratio between the ones of figure of hour indicating drum 29 and the 24 hour switching gear wheel 38 is so set that the latter is rotated one revolution each time the drum 29 rotates 3 revolutions by virtue of the provision of the reduction gear 37.

Figure 5:
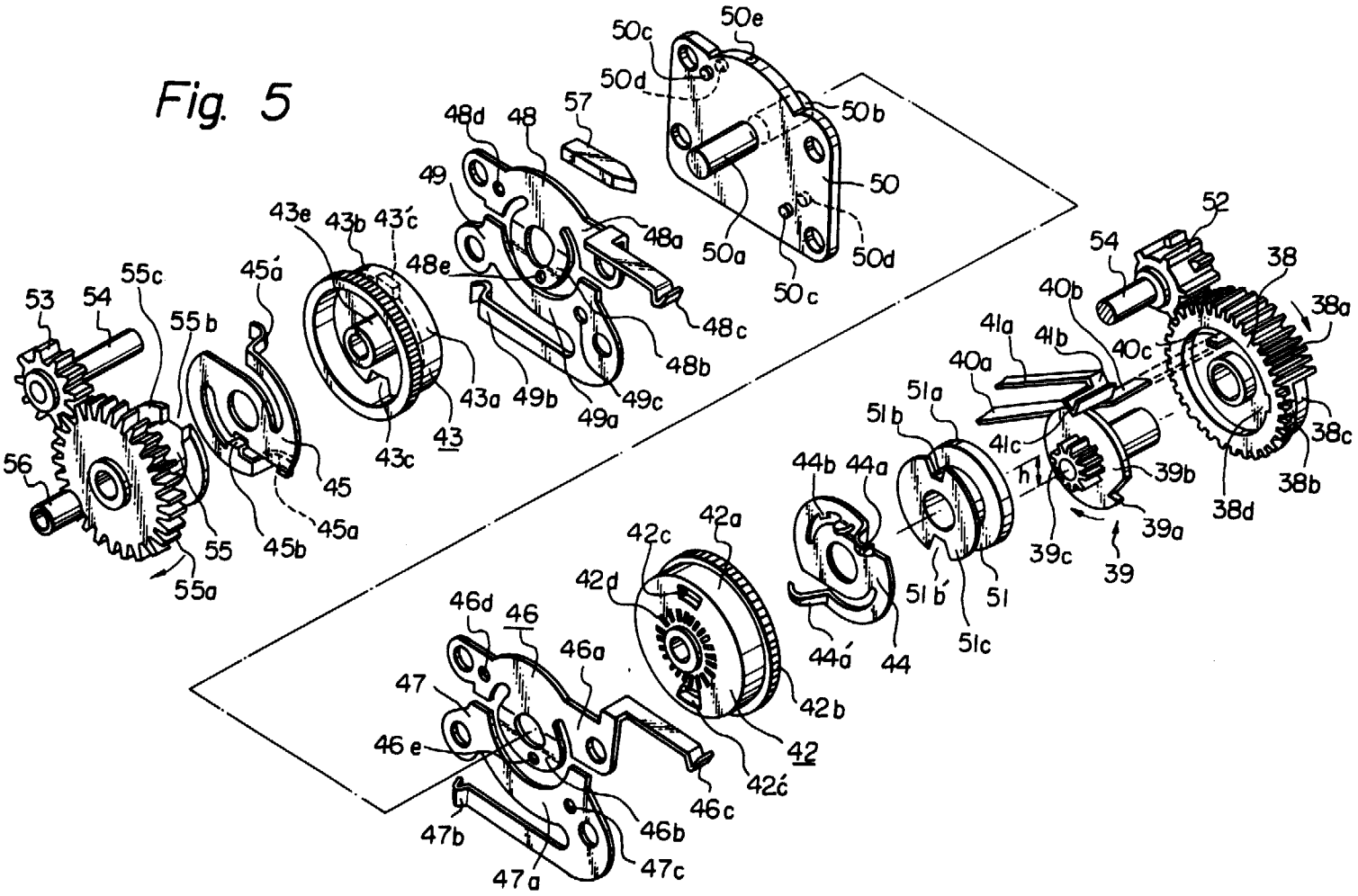
FIG. 5 is an exploded perspective view showing the timer mechanism of the present invention.

An hour feeding timer cam wheel 39 is secured to the driving shaft 23 (to which the tens of figure of minute indicating drum driving intermittent gear 22 if fixedly secured) and is provided with a flange cam portion 39*b* having a cut-out portion 39*a* and a pinion 39*c* integral with the timer cam wheel 39. A pair of contact members 40, 41 (FIG. 6) constitute a switch device and are secured to the supporting plate 13 (FIG. 1) and are each provided with a switch blade 40*a*; 41*a* extending therefrom having a contact portion 40*b*, 41*b* formed with a laterally extending lug 40*c*, 41*c*, respectively. The lug 40*c* cooperates with the recessed cam portion 38*d* of the gear wheel 38 (FIG. 5) while the lug 41*c* cooperates with the flange cam portion 39*b* of the timer cam wheel 39 as seen in FIG. 5. The contact members 40, 41 further comprise laterally extending contact terminal portions 40*d*, 41*d* having V-shaped contact portions 40*e*, 41e, respectively, which electrically contact with the respective electrically conductive portions on the upper extended portion 7*a* of the flexible printed circuit base plate 7, so that an electrical signal is fed to the circuit block 5 so as to drive the hour indicating driving motor 16 when the contact portions 40*b*, 41*b* are contacted with each other to electrically connect the contact members 40 and 41 by the actuation either of the lugs 40*c*, 41*c* cooperating with the recessed cam portion 38*d* of the gear wheel 38 and the flange cam portion 39*b* of the timer cam wheel 39 as described later.

The timer mechanism comprises as shown in FIGS. 4 and 5 a minute setting drum 42 having a cylindrical surface 42*a* on which four series of the minute graduations of five minute intervals "0", "5", "10", ——"55" are circumferentially formed, a knurled portion 42*b* for the manipulation of the drum 42, a pair of diametrically opposite throughholes 42*c*, 42*c*' formed in the side wall of the drum 42, and a plurality of clicking positioning recesses 42*d* formed on the side wall of the drum 42 along a circle concentric with the drum 42. The drum 42 is rotatably supported on a shaft 50*b* secured to an electrically insulating distance plate 50 and a pair of minute setting stationary contact members 46, 47 are secured onto the plate 50 in positions by means of locating pins 50*d* engaging with the holes in the contact members 46, 47, respectively.

Each of the contact members 46, 47 has a half circular sliding contact surface 46*a*, 47*a* complementary with each other. The contact member 46 is formed with a resiliently deformable portion 46*b* having a clicking projection which clickingly engages with a selected one of the clicking recesses 42*d* of the drum 42 for the selective positioning thereof so as to set the timer in terms of minute as well as a contact terminal portion 46*c* for electrical connection to the alarm device or a radio so as to actuate the same. The contact member 47 is formed with a contact portion 47*b* for selectively connecting the same to a contact portion 49*b* of a contact member 49 to be described later so as to actuate the timer mechanism.

In order to electrically connect the contact members 46 and 47 to each other so as to actuate the timer, a contact member 44 is fixedly secured to the inside of the drum 42. The contact member 44 has a pair of diametrically oppositely located contact arms 44*a*, 44*a*' extending through the throughholes 42*c* and 42*c*' in the drum 42 so as to resiliently contact with the contact member 46 or 47 depending upon the set position of the drum 42 as manually set by the aid of the minute graduations on the cylindrical surface 42*a* of the drum 42 cooperating with an index 50*e* provided in the distance plate 50, thereby permitting the contact members 46, 47 to be electrically connected to each other.

In order to prevent the contact portion 44*a* from contacting with the contact member 46 or 47 until the set time is achieved, a projection 44*b* is provided adjacent to the contact arm 44*a*, and the projection 44*b* normally abuts against a flange cam portion 51*c* of a timer cam wheel 51 as shown in FIG. 4 so that the contact portion 44*a* is held apart from the contact member 46 or 47. The timer cam wheel 51 is rotatably supported on the shaft 50*a* of the distance plate 50 and is provided with internal gear teeth 51*a* as shown in FIG. 4. The axis of the shaft 50*a* as shown in FIG. 5 is offset by the distance h in parallel to the axis of the pinion 39*c* of the hour feeding timer cam wheel 39 which is rotated together with the main shaft 23 so that the internal gear teeth 51*a* is rotated by the pinion 39*c*. The gear ratio between the internal gear teeth 51*a* and the pinion 39*c* is so determined that the timer cam wheel 51 is rotated half a revolution each time the pinion 39c and, hence, the main shaft 23 rotate one complete revolution. The flange cam portion 51c is provided with a pair of diametrically oppositely located cut-out portions 51b, 51b', and each of the cut-out portions 51b, 51b' is adapted to release the projection 44b of the contact member 44 from the flange cam portion 51c when it comes to the position in registration with the cut-out portion 51b or 51b' as the cam wheel 51 rotates so that the contact arm 44a is allowed to move resiliently to contact with the contact member 46 or 47 to complete the connection between the contact members 46, 47. After a certain time period after the contact arm 44a has contacted with the contact member 46 or 47, the contact arm 44a is moved apart from the contact member 46 or 47 by the flange cam portion 51c when the cut-out portion 51b or 51b' moves apart from the projection 44b as the cam wheel 51 rotates so as to electrically disconnect the contact members 46 and 47 from each other.

Figure 1:
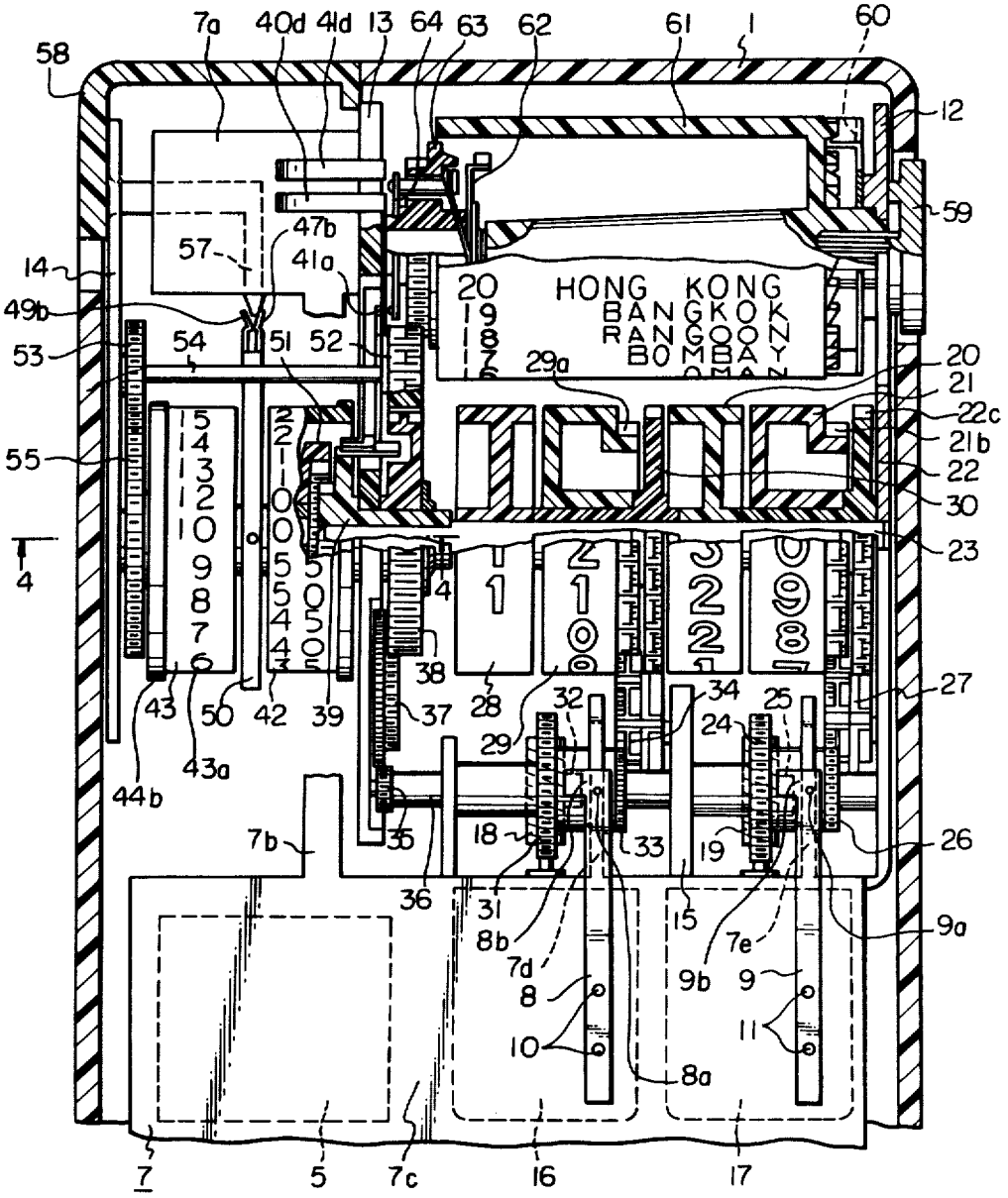
FIG. 1 is a front view with the front wall portion broken away showing the internal construction of an embodiment of a clock having the timer mechanism constructed in accordance with the present invention.

A manually operable member 58 is mounted in the casing 1 so as to slide upwardly and downwardly as viewed in FIG. 1, and it is capable of moving further slidingly inwardly or downwardly in the casing 1 from its position shown in FIG. 1. A manipulatable insulating member 57 integrally formed to the member 58 is inserted between the contact portions 47b and 49b of the contact members 47 and 49 so that electrical connection therebetween is disconnected.

In like manner, an hour setting drum 43 having hour graduations "0", "1", "2", ——"23" on the cylindrical surface 43a, a knurled portion 43b and a pair of diametrically located throughholes 43c, 43c' is rotatably supported on a shaft 50a of the distance plate 50 and a contact member 45 is secured to the drum 43 so that the contact arms 45a, 45a' are resiliently urged through the throughholes 43c, 43c' so as to contact with a pair of contact members 48, 49 secured to the distance plate 50 by positioning pins 50c and having the construction and arrangement symmetrical with those of the contact members 46, 47 providing a pair of semi-circular complementary sliding contact surfaces 48a, 49a, the contact terminal portion 48c of the contact member 48 being adapted to be connected to the warning device or the radio for actuating the same, while the contact portion 49b is adapted to selectively contact with the contact portion 47b of the contact member 47 when the manipulatable insulating member 57 for separating the both contact portions 47b, 49b is moved away from therebetween and a projection on a resiliently deformable portion 48b clickingly positions the drum 43 in a set position by the cooperation with the clicking positioning recesses 43d formed in the drum 43 (FIG. 4).

In a like manner as in the case of the contact member 44, the contact arm 45a is normally prevented from contacting with the contact member 48 or 49 by the projection 45b formed adjacent to the contact arm 45a and abutting against a flange cam portion 55c of a timer cam wheel 55 rotatably supported on the shaft 50a of the distance plate 50 (FIG. 4). The flange cam portion 55c is provided with a cut-out portion 55b so that the projection 45b is released from the flange cam portion 55c so as to allow the contact arm 45a to contact with the contact member 48 or 49 thereby electrically connecting the contact members 48, 49 to each other when the cut-out portion 55c comes into registration with the projection 45b as the timer cam wheel 55 rotates.

A spacer sleeve 56 serves to locate the drum 43 as shown in FIG. 4.

A gear portion 55a integrally formed with the timer cam wheel 55 meshes with a transmitting gear 53 secured at one end of a shaft 54 supported by the supporting plate 14, and an intermittent gear 52 is secured to the other end of the shaft 54. The intermittent gear 52 has wider gear teeth in alignment with every other narrower gear teeth as shown in FIG. 5 and the gear 52 meshes with the 24 hour switching gear wheel 38 which is rotated one revolution during three revolutions of the ones of figure of hour indicating drum 29, thereby permitting the timer cam wheel 55 to be rotated intermittently in synchronism with the time indicating device previously described.

Figures 6, 7A, 7B:
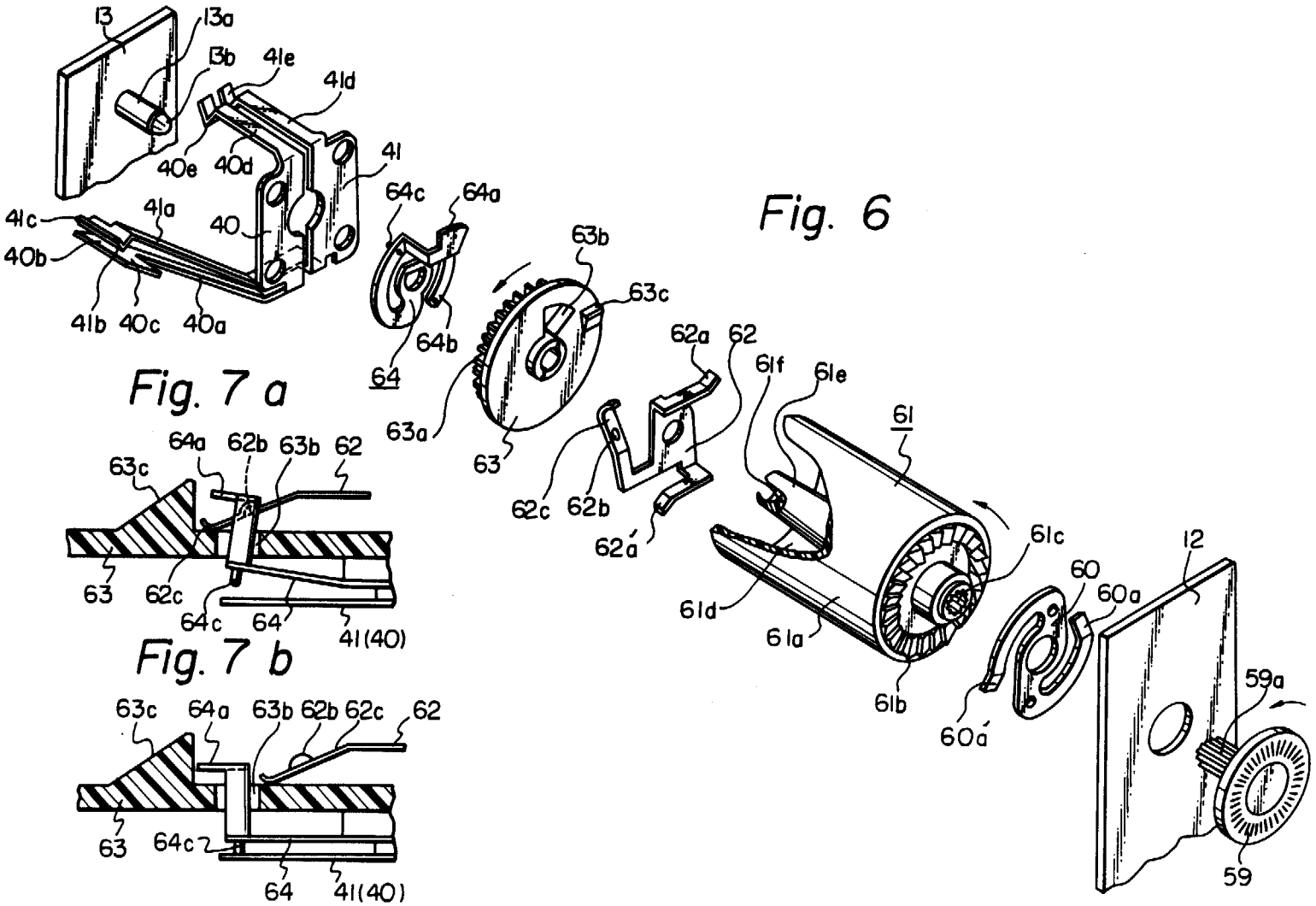
FIG. 6 is an exploded perspective view showing the mechanism for selectively showing the names of cities in the clock the time at which cities is switchingly indicated in the clock.

The city indicating device comprises as shown in FIGS. 6 and 7, a shaft portion 13a secured to the supporting plate 13 and having a semi-spherical projection 13b at its tip. The previously described contact members 40, 41 secured to the supporting plate 13 constitute a pair of semi-circular complementary sliding contact surfaces and a movable contact member 64 cooperates with the contact members 40, 41 as described later.

A manually actuatable knob 59 is rotatably supported by the supporting plate 12 and a cylindrical city indicating drum 61 is engaged with the knob 59 by the engagement of a splined portion 61c of the drum 61 with the complementary splined portion of the knob 59 so as to be manually rotated together with the knob 59.

The drum 61 bears on its cylindrical outer surface 61a the names of various cities in the world (FIG. 1) using standard time and having time differential of an hour (i.e. 15° in longitude) from each other at angular intervals dividing the entire peripheral surface 61a of the drum 61 into 24 sections, and the drum 61 is provided with an annular ratchet teeth 61b at the side surface of the drum 61 which engage with a pair of claw portions 60a, 60a' of a ratchet spring 60 secured to the supporting plate 12 so that the drum 61 can be rotated in the direction indicated by the arrow by the manipulation of the knob 59 to switch the indication of the name of the city on the drum 61 visible through the opening 1a of the casing 1 but the rotation in the direction opposite to that indicated by the arrow is prevented by the ratchet teeth 61b engaging with the claw portions 60a, 60a' of the ratchet spring 60. The drum 61 is formed with a central shaft portion 61e extending centrally and axially of the drum 61 within the hollow space bounded by the inner cylindrical surface 61d of the drum 61. The shaft portion 61e is formed with a semi-spherical recess 61f at the tip of the shaft portion 61e which rotatably engages with the semi-spherical projection 13b so as to rotatably support the drum 61.

A spring plate 62 is rotatably supported on the shaft portion 13a and is provided with a pair of oppositely and outwardly extending inclined resilient claw portions 62a, 62a' slidingly engaging with the cylindrical inner surface 61d of the drum 61 and a curled resilient actuator terminal portion 62c having a projection 62b. The orientation of the inclined claw portions 62a, 62a' is so set that the spring 62 can be rotated in the counterclockwise direction while the drum 61 is held stationary by slipping the claw portions 62a, 62a' along the inner cylindrical surface 61d while the spring 62 is positively rotated in the counterclockwise direction when the drum 61 is rotated in the direction of arrow by the knob 59 by the sticking engagement of the claw portions 62a, 62a' with the inner cylindrical surface 61d.

A city indication switching wheel 63 is rotatably supported on the shaft portion 13*a* and provided with gear teeth 63*a* meshing with the intermittent gear 52 previously described in connection with the timer mechanism with reference to FIGS. 4 and 5 so that the wheel 63 is rotated in coupled relationsip with the time indicating device.

The wheel 63 is provided with a throughhole 63*b* and a projection 63*c* formed at the side surface of the wheel 63 and having a steep surface and an inclined surface as shown in FIGS. 6 and 7, the steep surface of the projection 63*c* facing in the direction of rotation of the wheel 63 while the inclined surface faces in the opposite direction.

The movable contact member 64 cooperating with the contact members 40, 41 is secured to the city indication switching wheel 63 so as to be rotated together therewith and is formed with a bent actuator contact terminal portion 64*a* passing through the throughhole 63*b* and resiliently positioned adjacent to the steep surface of the projection 63*c* of the wheel 63 and adapted to cooperate with the projection 62*b* of the actuator terminal portion 62*c* of the spring plate 62, a sliding contact portion 64*b* slidingly contacting at all times with the contact member 40 or 41 and a sliding contact portion 64*c* adapted to selectively contact with the contact member 40 or 41 and positioned adjacent to the contact terminal portion 64*a* at a position diametrically opposite with respect to the contact portion 64*b* depending upon the relative position of the spring plate 62 to the wheel 63 so that the contact members 40, 41 are electrically connected to each other so as to actuate the hour indicating driving motor 16 when the contact portion 64*c* is brought in contact with the contact member 40 or 41.

As shown in FIG. 7, the spring plate 62 is normally rotated in the counterclockwise direction by the city indication switching wheel 63 by the engagement of the terminal portion 62*c* urged with the steep surface of the projection 63*c* while the drum 61 is held stationarily so that the projection 62*b* urges the terminal portion 64*a* of the contact member 64 upwardly so as to maintain the projection 64*c* apart from the contact member 40 or 41 thereby electrically disconnecting the contact members 40, 41 from each other as shown in FIG. 7(*a*), whereas, when the drum 61 is manually rotated in the counterclockwise direction for switching the indication of the name of the city, the spring plate 62 is forcibly rotated in the same direction so that the terminal portion 62*c* and hence the projection 62*b* of the spring plate 62 are moved away from the terminal portion 64*a* of the contact member 64 which is rotated together with the wheel 63 driven in coupled relationship with the time indicating device, thereby allowing the contact portion 64*c* to resiliently contact with the contact member 40 or 41 to electrically connect the contact members 40, 41 for driving the hour indicating driving motor 16 (FIG. 7(*b*)) until the steep surface of the projection 63*c* of the wheel 63 again abuts against the terminal portion 62*c* of the spring plate 62 to disconnect the contact projection 64*c* of the contact member 64 from the contact member 40 or 41 and the spring plate 62 continues to rotate together with the wheel 63. This serves to switch the indication of hour correspondingly to the switching of the indication of the name of the city.

The inclined surface of the projection 63*c* of the wheel 63 serves to allow the terminal portion 62*c* of the spring plate 62 to ride over the projection 63*c* and the terminal portion 64*a* of the contact member 64 without affecting the electrical contact between the contact member 40 or 41 and the projection 64*c* of the contact member 64 even though the spring plate 62 is excessively rotated in the counterclockwise direction by the city indicating drum 61.

The function of the above described device of the present invention will be described hereinafter.

By means of each of the signals of the minute intervals generated by the circuit block 5, the minute indicating driving motor 17 is driven so as to rotate the cam having the land portions 25 through the worm gear 19 and worm wheel 24. During the rotation of the cam, the cam portion 9*b* of the movable contact portion 9 falls from one of the two land portions 25 so as to move the contact 9*a* into contact with the contact portion 7*e* of the printed circuit base plate 7 thereby continuing the driving of the minute indicating driving motor 17 while the output signal from the circuit block 5 is shut down. When the other land portion 25 contacts and urges the cam portion 9*b* radially outwardly as the cam rotates, the contact portion 7*e* is disconnected from the contact 9*a* thereby deenergizing and stopping the motor 17. Thus, the cam having two oppositely located land portions 25 and hence the pinion 26 integral therewith are rotated intermittently by half a revolution in every minute so as to rotate the intermittent gear 27. Therefore, the ones of figure of minute indicating drum 21 is switched to indicate the next minute indication in every minute through the intermittent gear portion 21*b* while the tens of figure of minute indicating is switched to indicate the succeeding indication of tens of figure of minute in every ten minutes in synchronism with the switching of the last indication of ones of figure of minute through the intermittent gear 22 as previously described.

The hour feeding timer cam 39 having the flange cam portion 39*b* and the cut-out portion 39*a* therein is rotated together with the tens of figure of minute indication drum driving intermittent gear 22 through the main shaft 23 so that, when the cut-out portion 39*a* engages with the lug 40*c* of the contact member 41 during the rotation of the cam wheel 39, the contact portion 41*b* is moved inwardly and contacts with the contact portion 40*b* of the contact member 40 so that a signal is issued by the circuit block 5 in every hour to drive the hour indicating driving motor 16 in synchronism with the switching of the last indication "59" of the minute indicating mechanism.

The driving operation of the motor 16 is similar to that of the minute indicating mechanism and the tens of figure of hour indicating drum 28 and the ones of figure of hour indicating drum 29 are driven so as to properly indicate the time in terms of 24 hour cycle through the cam having two oppositely located land portions 32, the pinion 33 integral therewith, the hour indicating intermittent gear 34 and the tens of figure of hour indicating drum driving intermittent gear 30.

To this end, the 24 hour switching gear wheel 38 is rotated through the gears 35 (rotated together with the worm wheel 31) and the reduction gear 37 by one revolution each time the ones of figure of hour indicating drum 29 rotates three revolutions. As shown in FIG. 5, the lug 40*c* of the contact member 40 engages with the recessed cam portion 38*d* of the wheel 38 so as to move the contact portion 40*b* in contact with the contact portion 41*b* of the contact member 41 thereby energizing the hour indicating driving motor 16 when the drum 29 proceeds beyond the third revolution, i.e., the hour indication proceeds beyond 20 hour indication. The recessed cam portion 38d is so configured that the driving motor 16 continues to rotate the drum 29 so as to skip over the indication "24", "25", "26", ——"29" so that the indication "0:00" is achieved after the indication "23:59" is terminated so as to be switched to the succeeding indication.

The function of the timer mechanism is clear from the showing of FIGS. 4 and 5. The contact arm 44a which is held disconnected from the contact member 46 or 47 by the projection 44b abutting against the flange cam portion 51c while the contact arm 44a' contacts at all times with the contact member 46 or 47 is moved to contact with the contact member 46 or 47 at the set time as set in the minute setting drum 42 when the cut-out portion 51b or 51b' comes into registration with the projection 44b during the rotation of the cam wheel 51 which is driven by the main shaft 23 through the engagement of the pinion 39c with the internal gear teeth 51a. In the similar manner, the contact arm 45a is brought into contact with the contact member 48 or 49 at the set time as set in the hour setting drum 43 during the rotation of the cam wheel 55 driven in coupled relationship with the hour indicating device through the gear wheel 38, the gear 52, the shaft 54 and the gear 53, while the contact arm 45a' contacts at all times with the contact member 48 or 49. Therefore, when both pairs of contact members 46, 47 and 48, 49 are electrically connected to each other with the insulating member 57 withdrawn from between the terminal contact portions 47b and 49b to electrically connect these portions to each other, the alarm or the radio connected to the terminal contact portions 46c, 48c is actuated at the set time.

It is only necessary to rotate the cam wheel 51 or 55 in order to move the contact arm 44a or 45a in contact with the corresponding contact member in contrast to the heretofore proposed mechanism wherein a pair of contact arms must be frictionally rotated in sliding contact with the mating members, thereby permitting the power to be greatly reduced while wear of the moving parts is reduced.

When the time in another city having a different time differential is to be indicated, the knob 59 is manually rotated so as to rotate the drum 61 for switching the indication of the name of the city to the desired city. Thus, the spring plate 62 is rotated together with the drum 61 so that the terminal portion 62c is moved away from under the actuator terminal portion 64a of the contact member 64 to allow the contact projection 64c to contact with the contact member 40 or 41 while the contact portion 64b is held contacted at all times with the contact member 41 or 40, thereby driving the hour indicating driving motor 16 to vary the hour indication until the time at the desired city is indicated when the terminal portion 62c again engages with the projection 63c to disconnect the projection 64c from the contact member 40 or 41 to deenergize the motor 16. Thus, the time in various cities having different time differentials is properly indicated by adjusting the city indicating drum 61.

We claim:

1. A timer mechanism in a clock comprising:

at least a manually settable timer drum rotatable about an axis of rotation thereof for setting the time with the aid of time graduations provided on said timer drum at which a timer is to be actuated, said timer drum having at least two throughholes angularly spaced from each other diametrically of said timer drum and each radially spaced at equal distances from said axis of rotation of said timer drum;

a pair of semicircular complementarily arranged stationary electrical contacts located along a circle concentric with said axis of rotation of said timer drum, said electrical contacts being normally electrically insulated from each other and when connected together being effective for actuating said timer, the radius of said circle being equal to the radial distance between said throughholes and said axis of rotation of said timer drum;

a resilient contact member secured to said timer drum, said contact member including a first contact finger operatively urged through one of said throughholes so as to resiliently contact with either one of said pair of semicircular stationary contacts depending upon the manually set position of said timer drum and a second contact finger operatively urged through said other throughhole so as to resiliently contact the other of said pair of semicircular stationary contacts thereby permitting said pair of semicircular contacts to be electrically connected to each other through said resilient contact member for actuating said timer, said second contact finger being provided with a projecting lug adjacent thereto extending in the direction toward said pair of semicircular stationary contacts; and a timer cam member coaxial with said timer drum and rotated at a speed coupled with said clock and having a circular flange interposed between said timer drum and said projecting lug so as to abut thereagainst thereby urging said second contact finger apart from said pair of semicircular stationary contacts, said flange having a cutout portion permitting said projecting lug to be released from the abutting relationship against said flange thereby permitting said second contact finger to contact said semicircular stationary contact, the angular position of said cutout portion of said flange being so determined with respect to said timer graduations on said timer drum that said second contact member is permitted to contact said semicircular stationary contact at the set time as manually set to said timer drum.

2. The timer mechanism according to claim 1, comprising:

a pair of manually settable timer drums, one of said drums being an hour setting drum and the other of said drums being a minute setting drum;

two pairs of said semicircular complementarily arranged stationary contacts, one of said pairs being hour stationary contacts and the other of said pairs being minute stationary contacts, said hour setting drum cooperating with said hour set of said pair of semicircular complementarily arranged stationary contacts and said minute setting drum cooperating with said minute set of said pair of semicircular stationary contacts;

an hour drum timer cam member associated with said hour drum and a minute drum timer cam member associated with said minute drum; and a resilient contact member for said hour drum and secured thereto and cooperating with said hour timer cam member and a resilient contact member for and secured to said minute drum and cooperating with said minute timer cam member, said hour timer cam member associated with said hour setting drum being rotated at a speed operatively coupled with an hour indicating mechanism of said clock while the timer cam member associated with said minute setting drum is rotated at a speed operatively coupled with a minute indicating mechanism in said clock.

3. The timer mechanism according to claim 2, including:

an insulating spacer member between said hour setting drum and said minute setting drum;

means securing said hour pair of said semicircular stationary contacts to one surface of said insulating spacer member, and means securing said minute pair of said semicircular stationary contacts to the opposite surface of said insulating member;

one end of one of said hour stationary contacts being disengageably connected to one end of one of said minute stationary contacts; and a manually operable insulating member, and means to releasably insert said insulating member between said one stationary contact of said hour set and said one stationary contact of said minute set for rendering said timer inoperative.

4. The timer mechanism according to claim 1, including a pair of said manually settable timer drums, one of said timer drums being a minutes drum and the other of said timer drums being an hours drum, and an electrically insulating distance plate between said drums including means rotatably supporting said drums and a pair of locating pins.

5. The timer mechanism according to claim 4, including a pair of said semicircularly complementarily arranged stationary contacts for each said manually settable timer drums, each of said stationary contacts including a contact portion, one for said minutes drum and the other for said hours drum, said contact portions being selectively connected together for actuation of the timer mechanism.

6. The timer mechanism according to claim 4, wherein said timer cam wheel is rotatably supported on said insulating distance plate.

* * * * *